US008024859B1

(12) United States Patent
Stafford et al.

(10) Patent No.: US 8,024,859 B1
(45) Date of Patent: Sep. 27, 2011

(54) OIL PUMP ANTI-WEAR PLATE FOR TRANSFER CASE AND METHOD OF USE

(75) Inventors: Maura J. Stafford, Warner Robins, GA (US); Gregg A. Nader, Libertyville, IL (US)

(73) Assignee: Sonnax Industries, Inc., Bellows Falls, VT (US)

( * ) Notice: Subject to any disclaimer, the term of this patent is extended or adjusted under 35 U.S.C. 154(b) by 860 days.

(21) Appl. No.: 12/077,831

(22) Filed: Mar. 20, 2008

Related U.S. Application Data

(60) Provisional application No. 60/918,947, filed on Mar. 20, 2007.

(51) Int. Cl.
*B23P 6/00* (2006.01)

(52) U.S. Cl. ..... 29/888.021; 29/401.1; 29/402.01; 29/402.03; 29/525.11; 184/6.27; 184/11.3; 74/606 R

(58) Field of Classification Search ..... 29/888.021, 29/401.1, 402.01, 402.03, 402.06, 402.08, 29/402.09, 402.11, 525.11; 417/360, 363; 184/6.27, 11.3, 6.13, 6.28, 26, 27.1
See application file for complete search history.

(56) References Cited

U.S. PATENT DOCUMENTS 7,946,830 B2 * 5/2011 Black ..... 417/360

OTHER PUBLICATIONS

Marchant Automative—Transfer Case Upgrade Instruction—Wayback macine date—Dec. 3, 2008.*

Adapt-A-Case Product. New Venture 236 Anti-Wear Plate. Jul. 10, 2006. www.adapt-a-case.com.

Merchant Automotive Product. MA Transfer Case Pump Updgrade. www.merchant-automotive.com/transfercasepumpupgradekit.aspx. Date unknown.

* cited by examiner

*Primary Examiner* — Derris Banks
*Assistant Examiner* — Azm Parvez
(74) *Attorney, Agent, or Firm* — Downs Rachlin Martin PLLC; Clifford F. Rey, Esq.

(57) ABSTRACT

A replacement oil pump plate for attachment to an original equipment manufacture oil pump within a transfer case for elimination of mechanical wear by replacing the abrasive aluminum tabs formed on the oil pump with low-friction plastic tabs is disclosed. The present plastic tab design redistributes the surface-to-surface contact between the magnesium transfer case and the aluminum pump tabs away from the original wear points so that any necessary weld repairs to the transfer case will not be disturbed. The present replacement pump plate is provided in a kit format including a pump plate, machine screws, plastic tabs, and installation instructions. The present invention also describes a method of installing the pump plate kit on the original equipment manufacture oil pump subassembly.

7 Claims, 10 Drawing Sheets

OIL PUMP ANTI-WEAR PLATE FOR TRANSFER CASE AND METHOD OF USE

CROSS-REFERENCE TO RELATED APPLICATION

This application claims the benefit under 35 U.S.C. 119(e) of U.S. Provisional Patent Application No. 60/918,947 filed Mar. 20, 2007 entitled Oil Pump Anti-Wear Plate for Transfer Case and Method of Use.

BACKGROUND OF INVENTION

The present invention relates to automotive four-wheel drive systems and, more particularly, to an oil pump anti-wear plate for the repair of transfer cases utilized in four-wheel drive vehicles of various manufacturers.

Presently there are many types of four-wheel drive systems. For purposes of this application the term "four-wheel-drive system" will be understood to define an automotive drive system for providing power to all four wheels on a part-time basis (i.e. four-wheel-drive can be switched ON and OFF manually).

The transfer case assembly or so-called transfer case 100 (FIG. 1) in such a part-time, four-wheel-drive system functions to lock the front-axle driveshaft to the rear-axle driveshaft so that all four wheels are forced to turn at the same speed. In the four-wheel-drive operating mode the vehicle is provided with substantially increased torque at the wheels to handle steep terrain and low-traction situations.

Currently many original equipment manufacturers utilize NEW VENTURE GEAR series 136, 236, 246, 261 or 263 transfer cases (hereinafter "the subject transfer cases") in their four-wheel drive vehicles. Such transfer cases are commercially available from New Venture Gear Manufacturing GmbH, Roitzsch, Germany. In the subject transfer cases 100 an oil pump 120 is typically installed within a magnesium housing 125 (FIG. 2) that is utilized for weight reduction. The transfer case 100 is attached to the aft end of the transmission. The output shaft of the transmission (not shown) engages a mating internal spline 130 within the oil pump 120, which generates hydraulic pressure to a clutch pack in the transfer case 100 to initiate four-wheel-drive operation.

In the construction of the subject transfer cases, internal pockets 140 are formed on the interior surface of the magnesium housing 125 (FIG. 2), which are designed to receive integral anti-rotation lugs 155 formed on the aluminum oil pump 120 to secure it in position. Because a small amount of movement of the oil pump 120 is necessary to keep the pump centered on the transmission output shaft, a concentrated area of surface-to-surface contact occurs as at 145 and results in mechanical fretting between the lugs 155 and the magnesium housing 125 eventually causing the lugs to wear through the softer magnesium housing and resulting in oil leakage from the transfer case 100.

Thus, the present oil pump anti-wear plate and method of use has been developed to resolve this problem and other shortcomings of the prior art.

SUMMARY OF THE INVENTION

Accordingly, the present invention provides an oil pump anti-wear plate that is attached to the original equipment manufacture (hereinafter "OEM") oil pump cover within the transfer case of a four-wheel-drive vehicle. The present anti-wear plate eliminates damage to the magnesium housing of the transfer case caused by mechanical fretting of the aluminum lugs formed on the oil pump against the softer magnesium housing.

Advantageously, the present anti-wear plate redistributes the surface-to-surface contact between the magnesium housing and the pump lugs away from the original wear points by the installation of low-friction plastic inserts on the present anti-wear plate so that any mechanical fretting is eliminated. Further, the plastic inserts ensure that any necessary weld repairs to the transfer case for preventing leakage will not be disturbed.

The present oil pump anti-wear plate is provided in a kit format including an anti-wear plate, machine screws, low-friction plastic inserts, and installation instructions. The present invention also provides a method of installing the anti-wear plate on the OEM oil pump to salvage the expensive magnesium housing.

There has thus been outlined, rather broadly, the important features of the invention in order that the detailed description thereof that follows may be better understood, and in order that the present contribution to the art may be better appreciated. There are additional features of the invention that will be described hereinafter and which will form the subject matter of the claims appended hereto.

Those skilled in the art will appreciate that the conception upon which this disclosure is based may readily be utilized as a basis for the designing of other structures, methods, and systems for carrying out the purposes of the present invention. It is important, therefore, that the claims be regarded as including such equivalent constructions insofar as they do not depart from the spirit and scope of the present invention.

Other features and technical advantages of the present invention will become apparent from a study of the following description and the accompanying drawings.

BRIEF DESCRIPTION OF THE DRAWINGS

The novel features of the present invention are set forth in the appended claims. The invention itself, however, as well as other features and advantages thereof will be best understood by reference to the following detailed description of an illustrative embodiment when read in conjunction with the accompanying figures, wherein:

DETAILED DESCRIPTION OF THE PREFERRED EMBODIMENTS

Figure 1:
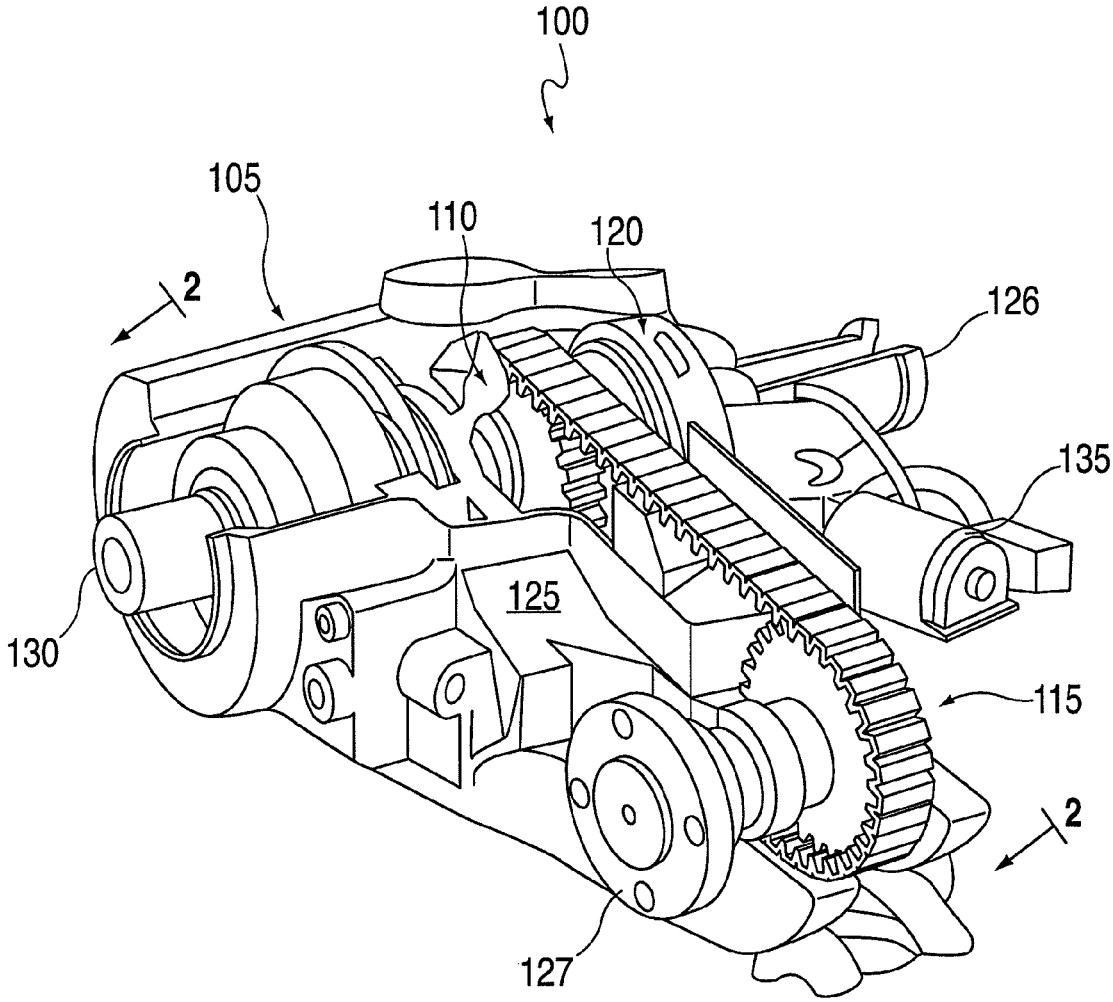
FIG. 1 (PRIOR ART)
FIG. 1 is a partially cutaway perspective view of a transfer case assembly wherein the present invention is utilized and is labeled Prior Art.

Prior to describing the present invention in detail, it may be beneficial to briefly review the structure and function of a prior art transfer case assembly, indicated generally at 100 and illustrated in FIG. 1. The transfer case assembly or transfer case 100 in a part-time, four-wheel-drive system functions to lock the front-axle driveshaft to the rear-axle driveshaft so that all four wheels are forced to turn at the same speed. The subject transfer case assemblies 100, which are utilized in part-time, four-wheel-drive systems, comprise a magnesium housing 125 containing a rear-axle output shaft 126 and a front-axle output shaft 127, a planetary gear set 105, a clutch pack 110, a drive chain 115, an oil pump 120 to actuate the clutch pack, and an electric motor 135 to shift the vehicle into four-wheel-drive operation. When shifted into four-wheel-drive, the vehicle is provided with substantially increased torque at the wheels to handle steep terrain and low-traction situations.

Figure 2:
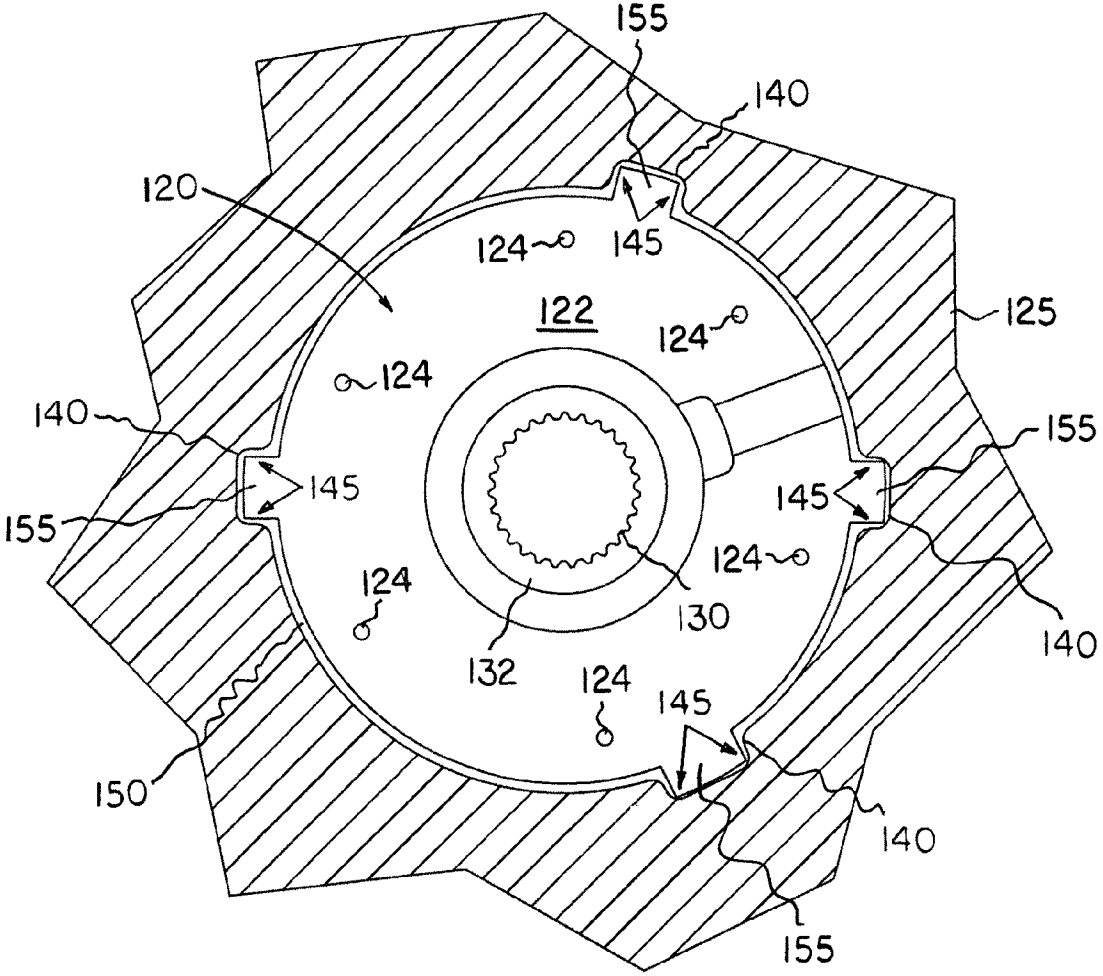
FIG. 2 PRIOR ART
FIG. 2 is a partial section view taken along the section line 2-2 of FIG. 1 showing the oil pump disposed in a recess in the magnesium housing wherein the oil pump assembly is installed.

In the construction of the subject transfer cases, a generally cylindrical recess 150 with radially extending pockets 140 is formed on the interior surface of the magnesium housing 125 (FIG. 2), which conforms to the contour of cover 122 of the oil pump 120 to secure it in position. Cover 122 includes a plurality of radially projecting, anti-rotation lugs 155 integrally formed thereon, which are received in the mating pockets 140. A plurality of threaded holes 124 is formed within cover 122 to attach the cover to the body of the oil pump 120.

Because a small amount of eccentric movement of the oil pump 120 is necessary to keep the pump centered on the transmission output shaft, concentrated areas of surface-to-surface contact occur as at 145 resulting in mechanical fretting between the lugs 155 and the magnesium housing 125. Such fretting action eventually causes the cast aluminum lugs 155 to wear through the softer magnesium housing 125, which results in oil leakage and eventual malfunction of the transfer case 100.

Figure 4:
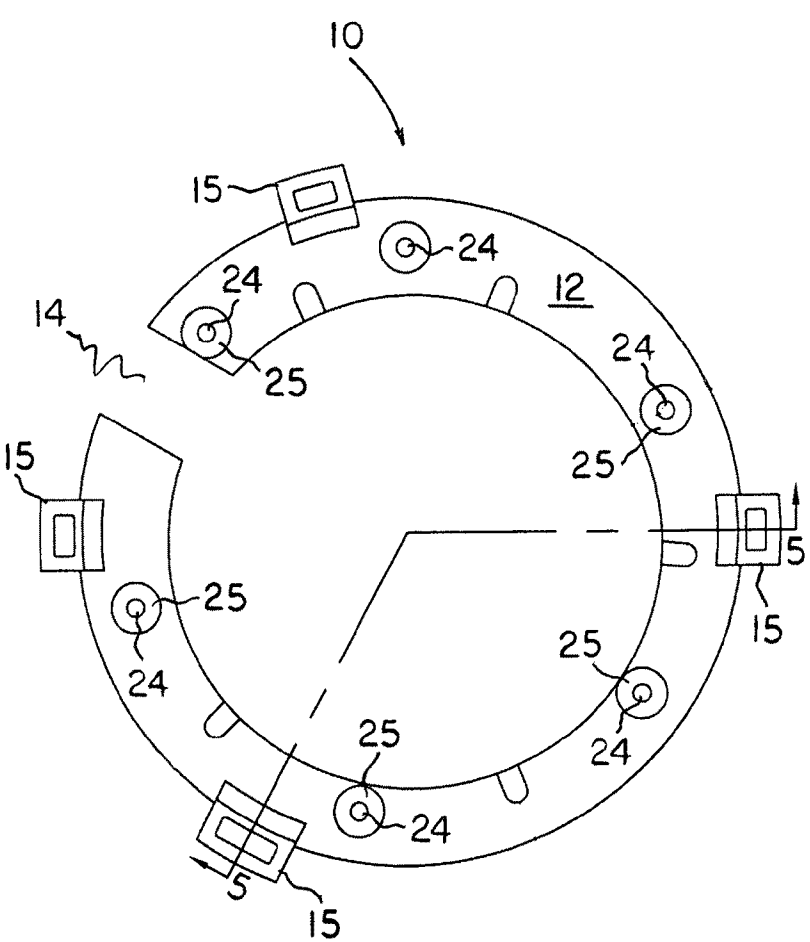
FIG. 4 is a bottom plan view of the present oil pump anti-wear plate shown rotated 180° from the position shown in FIG. 3.
Figure 3:
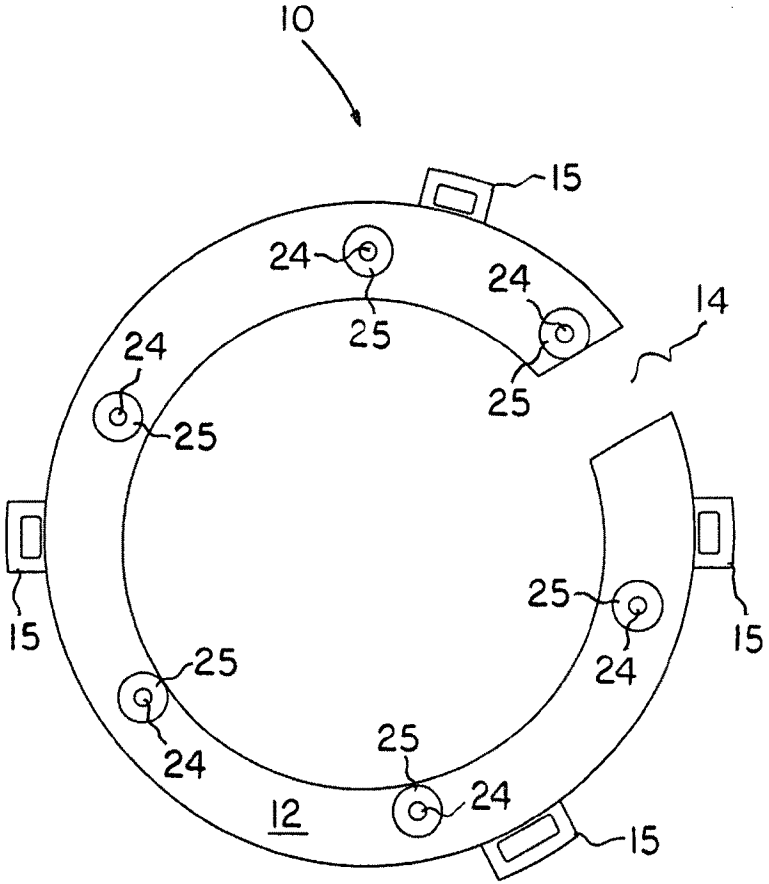
FIG. 3 is a top plan view of the oil pump anti-wear plate of the present invention.
Figure 7:
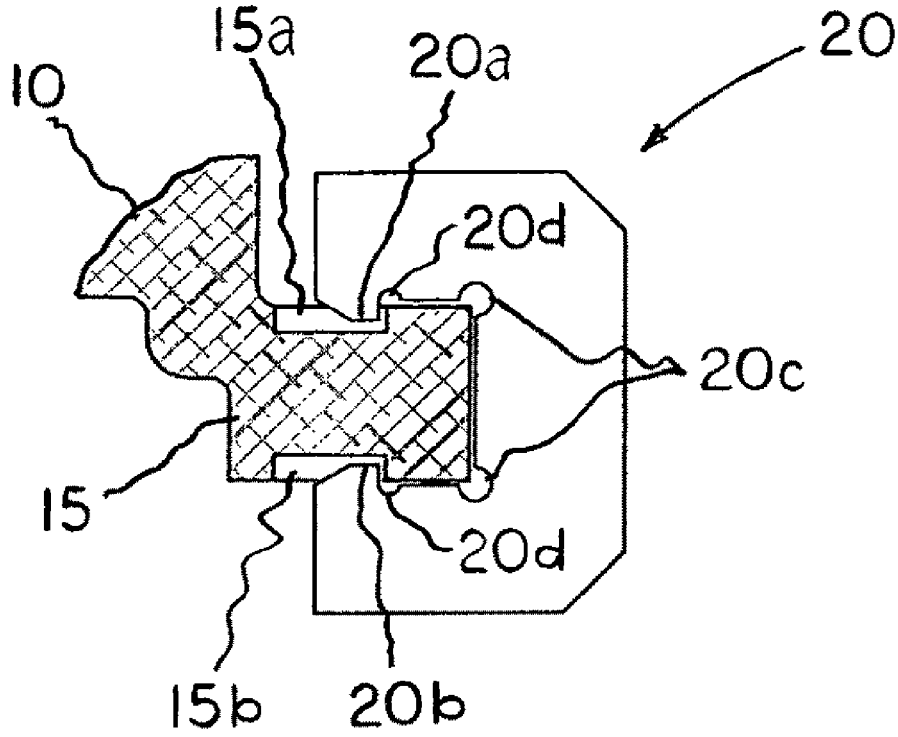
FIG. 7 is a partial section view of the oil pump anti-wear plate showing a low-friction insert installed thereon.

The present invention provides an oil pump anti-wear plate for the subject transfer cases to resolve this problem and will now be described. With further reference to the drawings, there is shown therein an oil pump anti-wear plate in accordance with the present invention, indicated generally at 10 and illustrated in FIGS. 3 and 4. Anti-wear plate 10 is a generally ring-shaped structure having a radial gap 14 that is fabricated from aluminum or other suitable material. Anti-wear plate 10 includes a plurality of integral mounting tabs 15 which are configured to receive low-friction inserts 20 (FIG. 7) thereon.

Figure 5:
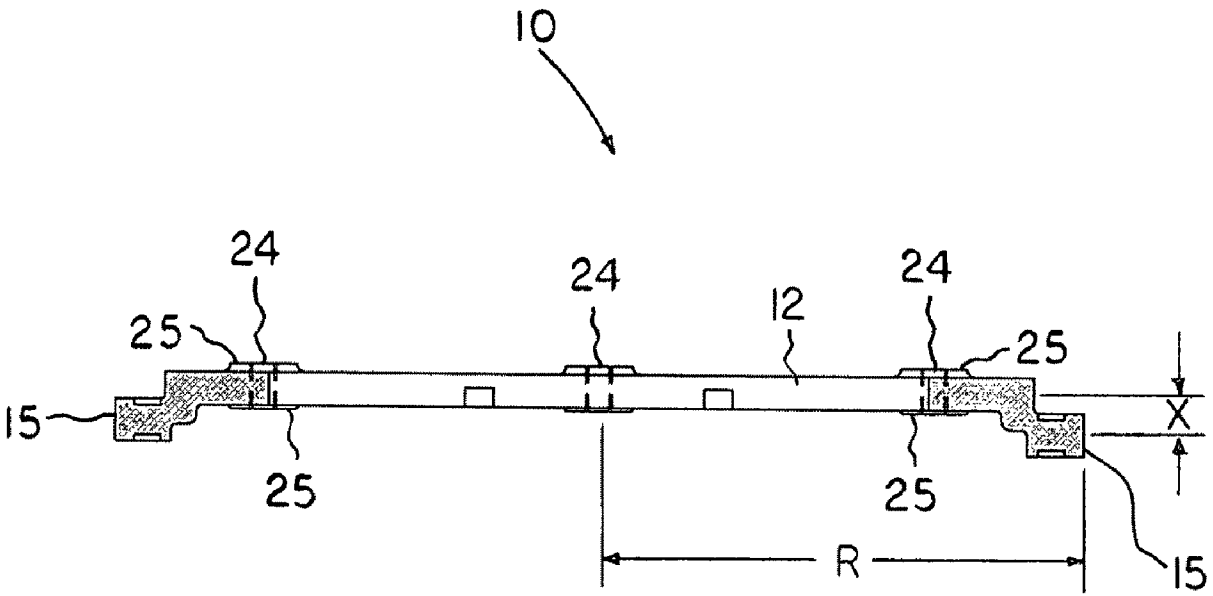
FIG. 5 is a section view of the present oil pump anti-wear plate taken along section line 5-5 of FIG. 4.

Referring to FIG. 5 mounting tabs 15 are located at the same angular orientation and substantially the same radial dimension "R" as lugs 155 on the OEM cover 122. In addition, tabs 15 are offset from the center plane of plate member 12 by a dimension "X" which is approximately equivalent to the thickness of the OEM cover 122. Anti-wear plate 10 also includes an array of mounting holes 24 which are located in predetermined positions in coaxial alignment with threaded holes 124 in the pump cover 122 after installation.

Figure 6A:
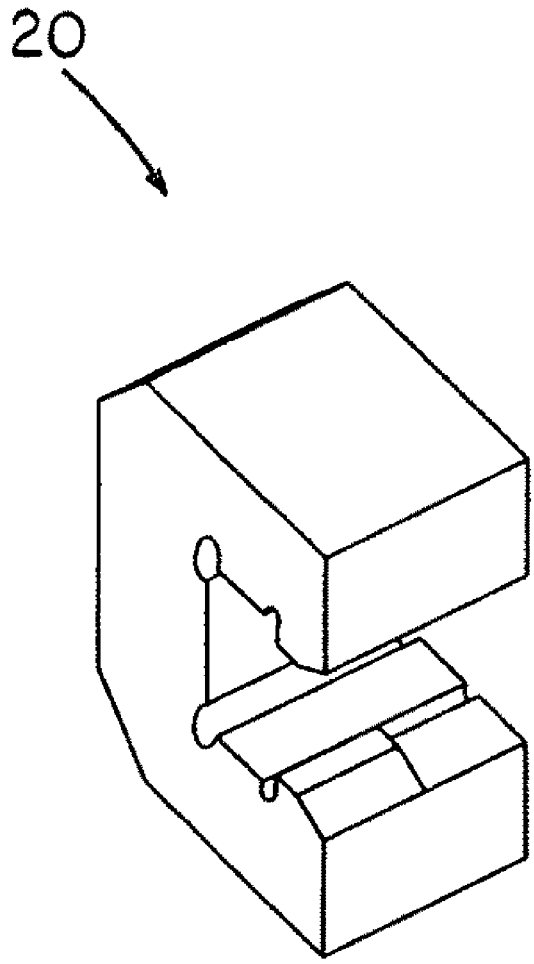
FIG. 6A is a perspective view of a low-friction insert in accordance with the present invention.
Figure 6B:
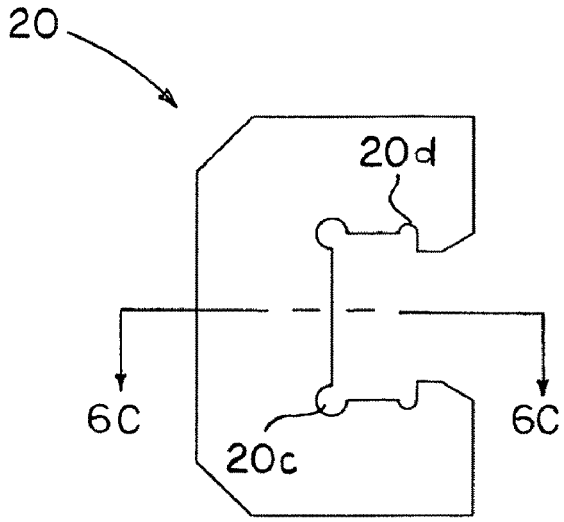
FIG. 6B is a side elevation view of the low friction insert of FIG. 6A.
Figure 6C:
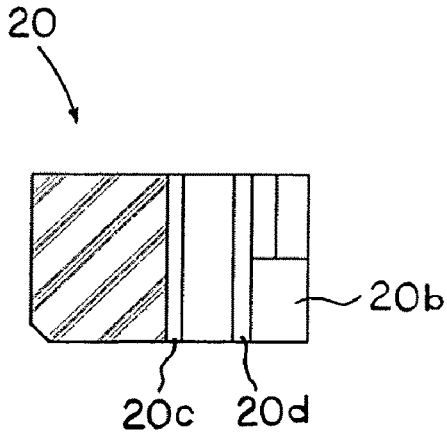
FIG. 6C is a section view of the low-friction insert taken along section line 6C-6C of FIG. 6B.

With reference to FIGS. 6A-6C there is shown a low-friction insert in accordance with the present invention, indicated generally at 20. Inserts 20 are fabricated from a high operating temperature, ultra high molecular weight (UHMW) polyethylene plastic such as TIVAR, or other plastic material having physical and chemical properties suitable for this purpose. It can be seen that inserts 20 are generally C-shaped in configuration and are designed to be installed on tabs 15, which are integrally formed on pump plate 10 as most clearly shown in FIG. 7. More particularly, a pair of opposed protuberances 20*a*, 20*b* formed on insert 20 are configured to engage mating detents 15*a*, 15*b* formed in tabs 15. Undercut relief zones 20*c*, 20*d* impart resiliency to inserts 20 to enable the inserts to be manually snapped in place and retained in position on tabs 15. In one embodiment of the present invention, a pair of such inserts 20 is installed on each tab 15 in side-by-side relation (FIG. 9).

Thus, it will be appreciated by those skilled in the art that the mounting tabs 15 with inserts 20 installed thereon are designed to provide the function of the OEM aluminum lugs 155 with the advantage of a low coefficient of friction and, thus, no abrasive effect on the magnesium housing 125. In addition, inserts 20 redistribute the surface-to-surface contact with the magnesium housing 125 away from the original wear points so that any mechanical fretting is eliminated. Further, any necessary weld repairs to the magnesium housing 125 for preventing leakage will not be disturbed.

Figure 8:
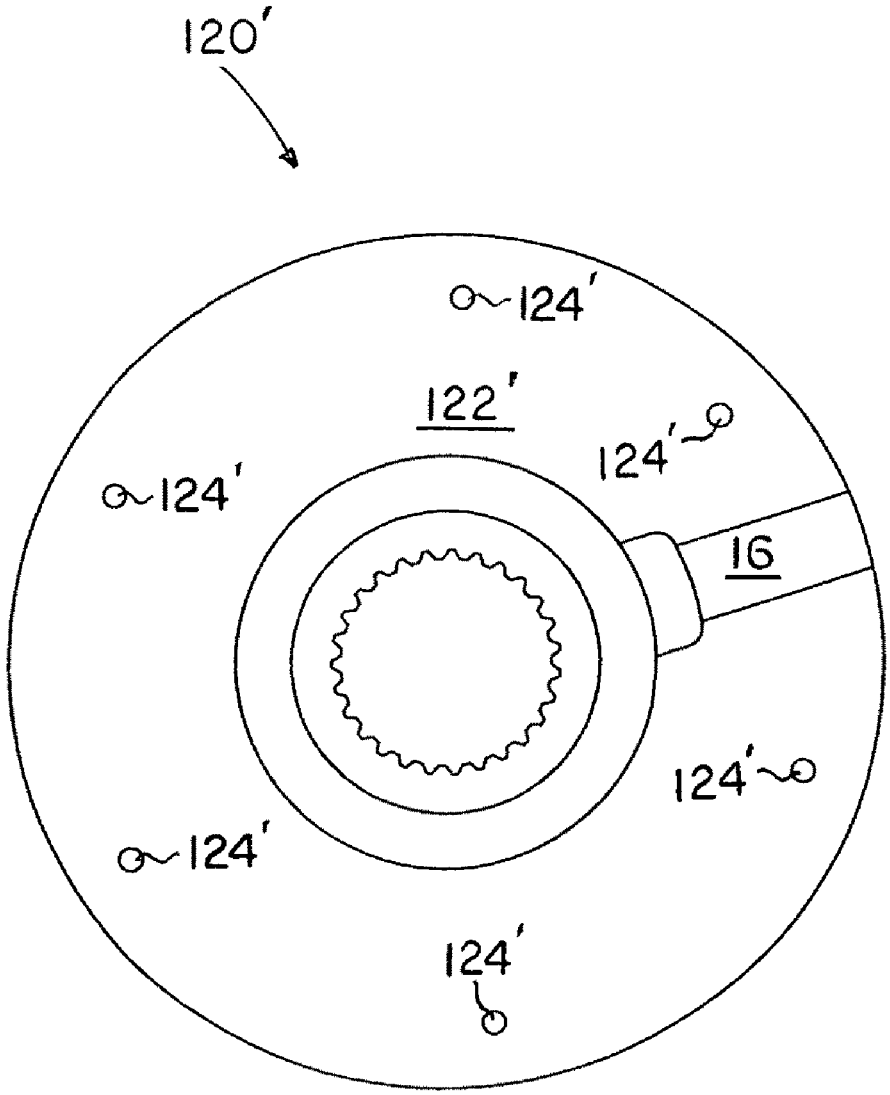
FIG. 8 is a top plan view of an OEM oil pump modified in accordance with the present invention and prior to the installation of the anti-wear plate.

In a method of using the present invention, the oil pump 120 is initially removed from the transfer case 100. Next, the oil pump 120 is disassembled by removing the OEM machine screws (not shown) from the pump cover 122 and the machine screws are discarded. Thereafter, the threaded machine screw holes 124 are drilled through using an 11/64 inch or slightly larger drill bit to remove the threads forming a plurality of modified mounting holes 124' (FIG. 8) in cover 122'. Next, using a hacksaw or other suitable tool cut off the OEM lugs 155 and then grind or file the remnants of the lugs until blended with the peripheral contour of the cover 122' of the modified pump 120' as shown in FIG. 8.

Figure 9:
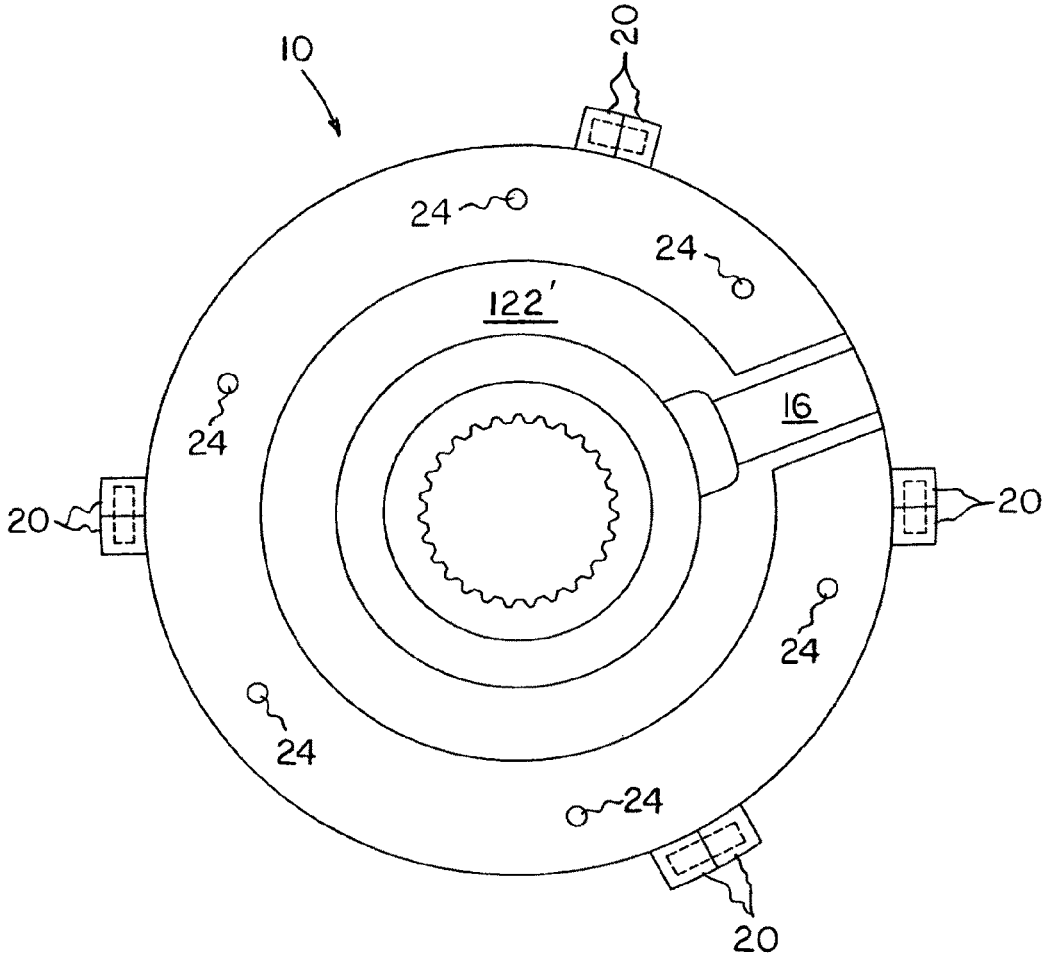
FIG. 9 is a top plan view of the modified OEM oil pump of FIG. 8 showing the anti-wear plate of the present invention installed thereon.
Figure 10:
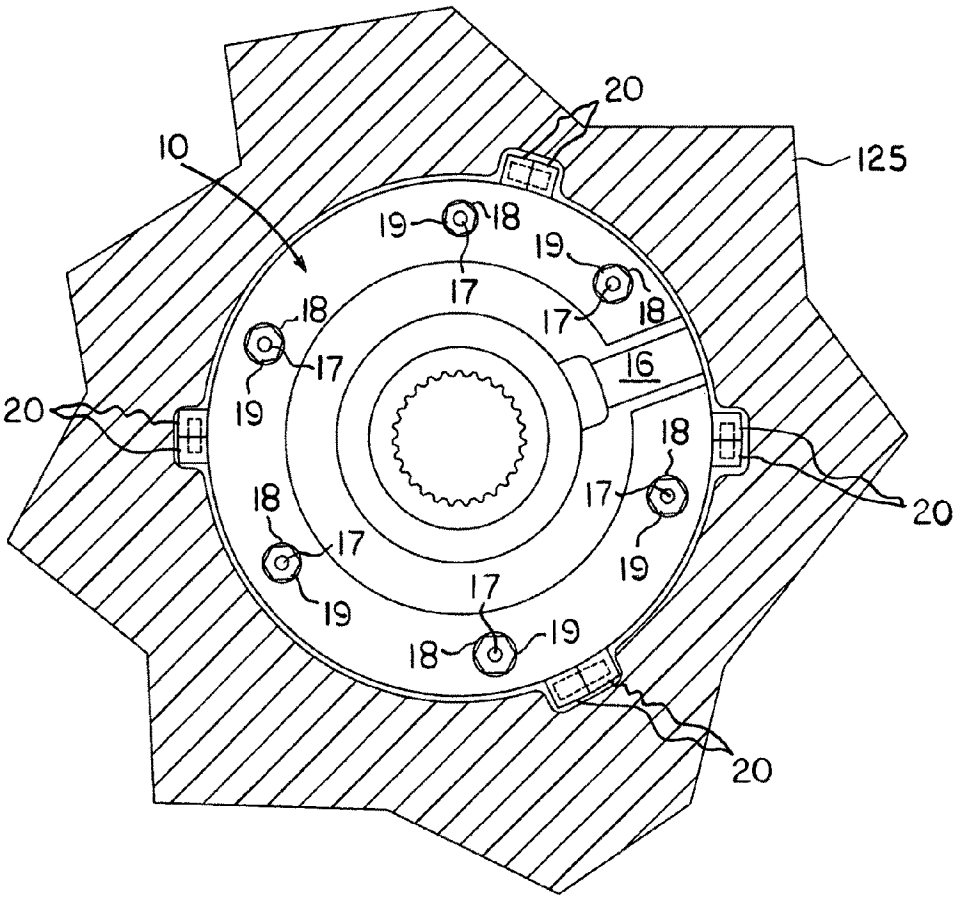
FIG. 10 is a cutaway plan view of the present anti-wear plate installed in a transfer case.

Next, the modified pump 120' is reassembled (i.e. without machine screws initially) and the pump plate 10 including inserts 20 installed thereon is positioned on the modified cover 122' such that mounting holes 24 are aligned with the modified mounting holes 124' in the cover and gap 14 is radially oriented with pump outlet 16 as shown in FIG. 9. Thereafter, new machine screws 17 of a predetermined size are installed from the bottom side of the pump 120' extending through cover 122' and anti-wear plate 10. Finally, a washer 18 and mating nut 19 provided in the present kit are attached to the new machine screws 17 to complete the installation.

Although not specifically illustrated in the drawings, it should be understood that additional equipment and structural components will be provided as necessary and that all of the components described above are arranged and supported in an appropriate fashion to form a complete and operative Oil Pump Anti-Wear Plate for Transfer Case and Method of Use incorporating features of the present invention.

Moreover, although illustrative embodiments of the invention have been described, a latitude of modification, change, and substitution is intended in the foregoing disclosure, and in certain instances some features of the invention will be employed without a corresponding use of other features. Accordingly, it is appropriate that the appended claims be construed broadly and in a manner consistent with the scope of invention.

Having described preferred embodiments of our invention, what we desire to secure by U.S. Letters Patent is:

1. A method of installing an anti-wear plate on an original equipment oil pump including a pump cover disposed within a transfer case of a four-wheel-drive vehicle, wherein said transfer case comprises a housing having a plurality of pump locating pockets formed therein, wherein said oil pump includes a plurality of anti-rotation lugs formed thereon for engagement in said pockets, said method comprising:

disassembling said original equipment oil pump;

altering said original equipment oil pump by removal of said anti-rotation lugs to create a modified oil pump;

attaching an anti-wear plate to said modified oil pump thereby conforming said modified oil pump to an external contour of said original equipment oil pump;

reassembling said modified oil pump including said anti-wear plate attached thereto; and reinstalling said modified oil pump with said anti-wear plate attached thereto within said housing.

2. The method of claim 1 wherein the disassembling further includes:

removing a plurality of original equipment machine screws from threaded holes formed in said pump cover;

drilling through said threaded holes to remove threads formed therein to create modified mounting holes; and discarding said plurality of original equipment machine screws.

3. The method of claim 2 wherein the altering further includes:

cutting off said anti-rotation lugs from said original equipment oil pump; and reshaping cut off remnants of said anti-rotation lugs to blend with an external profile of said original equipment oil pump to create said modified oil pump.

4. The method of claim 3 wherein the attaching further includes:

installing a plurality of low-friction inserts onto said anti-wear plate in replacement of said anti-rotation lugs;

inserting a plurality of replacement machine screws through said modified mounting holes in said pump cover and through said mounting holes in said anti-wear plate; and engaging a plurality of mating threaded nuts on said replacement machine screws to attach said anti-wear plate to said modified oil pump.

5. The method of claim 1 wherein the disassembling further includes:

removing a plurality of original equipment machine screws from threaded holes formed in said pump cover; and drilling through said threaded holes to remove threads formed therein to create modified mounting holes.

6. The method of claim 1 wherein the altering further includes:

cutting off said anti-rotation lugs from said original equipment oil pump; and reshaping cut off remnants of said anti-rotation lugs to blend with an external profile of said original equipment oil pump to create said modified oil pump.

7. The method of claim 1 wherein the attaching further includes:

installing a plurality of low-friction inserts onto said anti-wear plate in replacement of said anti-rotation lugs;

inserting a plurality of replacement machine screws through said modified mounting holes in said pump cover and through said mounting holes in said anti-wear plate; and engaging a plurality of mating threaded nuts on said replacement machine screws to attach said anti-wear plate to said modified oil pump.

* * * * *